United States Patent [19]

Günnewig

[11] 4,083,488

[45] Apr. 11, 1978

[54] CENTRIFUGAL SEPARATOR HAVING HYDRAULICALLY OPERATED OUTLET VALVES

[75] Inventor: Hubert Günnewig, Oelde, Germany

[73] Assignee: Westfalia Separator AG, Oelde Westfalen, Germany

[21] Appl. No.: 773,872

[22] Filed: Mar. 2, 1977

[30] Foreign Application Priority Data

Mar. 9, 1976 Germany ..... 2609663

[51] Int. Cl.[2] ..... B04B 11/02

[52] U.S. Cl. ..... 233/20 A

[58] Field of Search ..... 233/20 R, 20 A, 19 R, 233/19 A

[56] References Cited

U.S. PATENT DOCUMENTS

| | | | |
|---|---|---|---|
| 3,160,589 | 12/1964 | Stone | 233/20 A |
| 3,550,843 | 12/1970 | Hoffmann | 233/20 A |
| 3,797,736 | 3/1974 | Gunnewig | 233/20 R |
| 3,871,575 | 3/1975 | Niemeyer | 233/20 A |

FOREIGN PATENT DOCUMENTS

| | | | |
|---|---|---|---|
| 685,834 | 5/1964 | Canada | 233/20 A |
| 2,048,429 | 4/1972 | Germany | 233/20 A |

*Primary Examiner*—George H. Krizmanich

*Attorney, Agent, or Firm*—Burgess, Dinklage & Sprung

[57] ABSTRACT

A centrifugal separator for the concentration of suspended solids has a rotatable drum and hydraulically operated outlet valves uniformly distributed about the periphery of the drum in the plane of greatest drum diameter. The valves include nozzle apertures and movable valve bodies therein. The valve bodies are mounted to close the nozzle apertures by the centrifugal force of the drum at full rotary speed and are displaced to an open position in response to the feeding of operating liquid during use. A liquid ring valve controllably releases the operating liquid to effect the reclosing of the nozzle apertures under the action of the centrifugal force.

8 Claims, 1 Drawing Figure

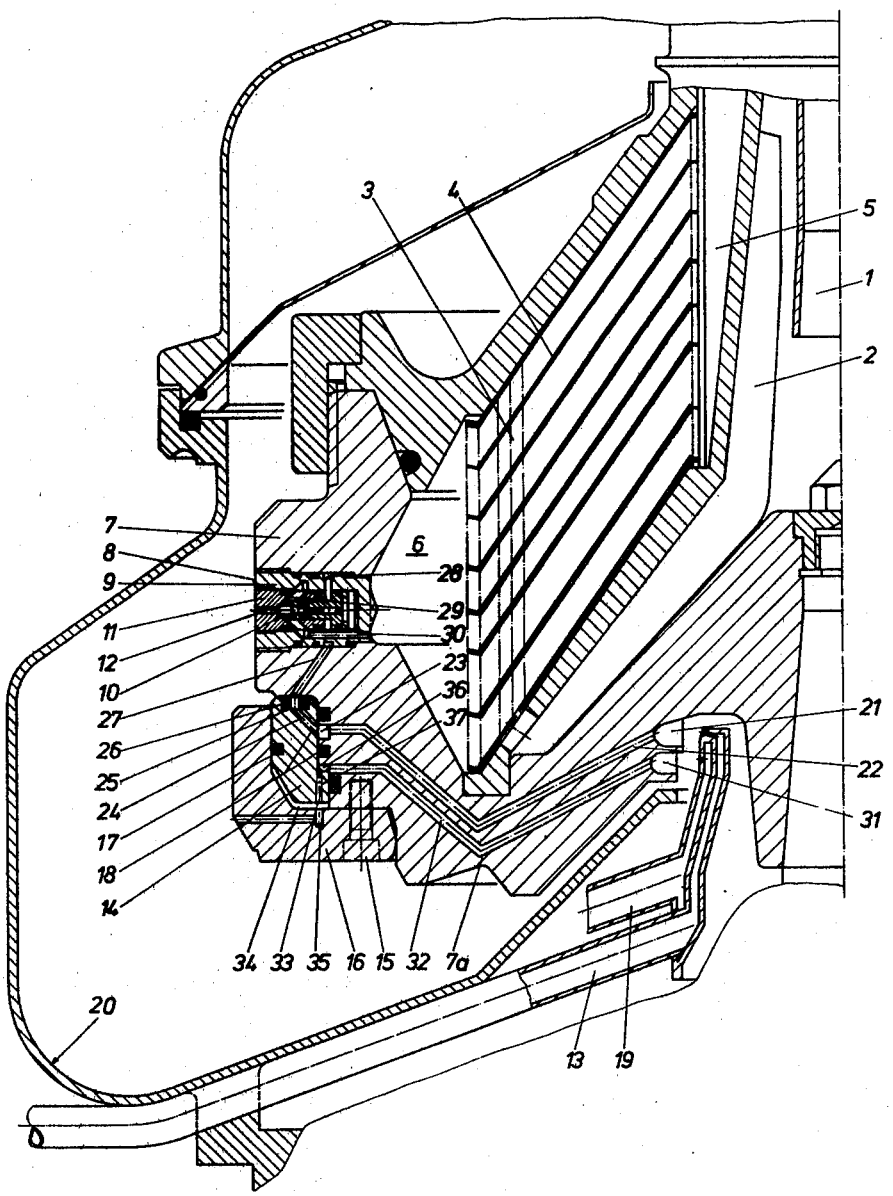
3
4
5
1
2
7
8
9
11
12
10
27
26
25
24
17
18
14
6
28
29
30
23
36
37
21
22
31
34
33
35
16
15
32
7a
20
13
19

CENTRIFUGAL SEPARATOR HAVING HYDRAULICALLY OPERATED OUTLET VALVES

BACKGROUND

The invention relates to a centrifugal separator having hydraulically operated outlet valves, for the concentration of suspended solids, said valves being uniformly distributed about the circumference of the drum in the plane of the greatest drum diameter, passages for carrying the operating liquid extending through the floor of the drum, said valves having movable valve bodies protected against the pressure of the drum charge, closing nozzle apertures at the periphery of the drum by centrifugal force at full rotatory drum speed and being displaced radially towards the drum axis during operation by means of an operating liquid and thereby releasing nozzle apertures for the emergence of the concentrate.

A centrifugal separator of this kind is known, for example, from German Utility Model 75 27 869.

Centrifugal separators of this type of construction are used for the concentration of solids which are of a soft, e.g. yeasty, consistency, but also for the concentration of solids of greater specific weight, which are preferably spun out through nozzles located at a relatively great distance from the drum axis, normally at the periphery of the drum, and the content of solids in the suspension can vary greatly. Furthermore, it must be possible for the solid material to be raised to a very high concentration.

The nozzles disposed at the periphery of the drum for the emergence of the concentrate are opened whenever the movable valve bodies in the valves are moved radially toward the drum axis. The timing of the valve openings can be automatically controlled through a control apparatus on the basis of the emerging concentrate or of the emerging clear phase. It is disadvantageous in this system that valve operating water must be fed to the valves during the entire open period if the valves are to remain open for a relatively long time. The consumption of valve operating water in this case is very great.

To remedy these disadvantages, the valve seats or the movable valve bodies have been provided with calibrated passages or slits, a certain amount of concentrate being carried off continually, and the valve bodies being opened completely only at certain intervals of time.

A disadvantage of this last-named construction is, however, that the calibrated passages or slits have to be adapted to the smallest flow of concentrate that is to be expected, and thus the necessity exists of keeping the nozzles and slits very small, but thereby creating the danger of rapid clogging if the solid particles are larger in diameter than the calibrated bores or slits.

THE INVENTION

The object of the invention thus consists in improving a known centrifugal separator such that the valves can be kept open for a relatively long period of time with a small amount of valve operating water.

This problem is solved in that the valve bodies opened by valve operating water will reclose the nozzle apertures by centrifugal force whenever the valve operating water is let out by means of a valve operating water ring valve. In this manner it is possible to keep the outlet valves open over a longer period of time with a small amount of valve operating water, until the valve operating water ring valve has let the water run out of the valve again and the outlet nozzles are reclosed.

Furthermore, if the concentrate outlet bore of the valves is made so large that the outflow corresponds to the maximum expected outflow of concentrate, the possibility is created for regulating the concentrate flow from zero to maximum by periodical opening and closing of the outlet valves, it being possible to establish the opening and closing times separately. By using a photelectric cell in the clear phase discharge, or by monitoring the concentrate outflow, it is possible to run maximum concentrations without losses.

In further development of the invention, the outlet valves are fed with valve operating water from a common annular chamber, the annular chamber being connected with the valve operating water injection chamber by only one or preferably two passages in the drum floor. Thus a uniform operation of the outlet valves is accomplished at minimum water consumption.

Another feature of the invention is that the valve operating water valve is actuated through operating water from a separate operating water injection chamber, and operating water valves of either the axial or radial type can be used.

The invention will be further explained below with the aid of the appended drawing representing a partial sectional view of an embodiment thereof.

The solid-containing suspension is delivered through the inlet pipe 1 into the distribution chamber 2 of the separator, flows through the risers 3 of the disk stack 4, the clear phase, being of lighter specific weight, flowing inwardly through the disk stack, and being able to flow through the passage 5 into a paring chamber, for example, and to be discharged. The separated, specifically heavier component, the concentrate, flows radially through the disk stack to the periphery of the drum and collects in the solids chamber 6. In the drum 7 the outlet valves 8 are distributed at uniform intervals about the circumference. Within the valve housing 9 of the outlet valve is a radially movable valve body 10, and a nozzle 11 having the nozzle aperture 12. The opening of the valves 8 is accomplished by the feeding of a certain amount of fluid through a supply line 13 disposed outside of the drum.

In the lower portion of the drum is the operating water ring valve 14 which is provided in accordance with the invention and which is guided for axial movement, sealed by the packings 17 and 18, between the drum and a ring 16 encompassing the operating water ring valve 14 and affixed to the drum by means of bolts 15.

The operation of the operating water ring valve 14 is accomplished by feeding operating liquid by means of a special feed line 19 disposed outside of the drum.

The outlet valves operate in conjunction with the operating water ring valve in the following manner:

During operation, the conical end of the valve body 10, which is movable and sealingly guided within the valve housing 9, closes the nozzle aperture 12 in the conical part of the nozzle 11 under the action of centrifugal force, and thus initially prevents the emergence of solids or concentrate from the solids chamber 6.

For the continual emptying of the solids chamber 6 through the nozzle apertures 12, a small amount of operating liquid is briefly fed through line 13 through the injection chamber 21 into the passages 22 in the drum bottom 7*a*. The operating liquid enters into the ring chamber 23 and is carried out of same through bores 24, 25 and 27 into the annular passage 28 where an omnidirectional liquid pressure builds up which moves the valve body 10 radially towards the drum axis against the centrifugal force, uncovering the annular gap 29 between the nozzle and the valve body, so that the solids are continually discharged through the bores 30, annular gap 29 and the discharge apertures 12 of the nozzle, into the concentrate catcher 20. The passage 22, the ring chamber 23, the passage 24 and the passages 27 form a passageway network having an inlet adjacent the drum axis, extending through the ring valve and on to the valves for supplying operating liquid to the valves for holding the valve bodies so that the nozzles are open. With the ring valve in the closed position, which is shown in the drawing, the passageway network is closed so that the passageway network holds the operating liquid therein.

Before the outlet valves 8 are charged with operating liquid, a small amount of operating liquid is fed through line 19 via injection chamber 31 and passage 32 in the drum bottom *7a* into the operating water ring valve 14, the said liquid, after filling the chamber 34 below the ring valve 14 through calibrated bores 33 all the way to the overflow bore 35, exercises, due to centrifugal force, a closing pressure on the ring valve 14, and presses the packing ring 26 in the ring valve against the bore 27 leading to the outlet valves 8, thus a continuous passage being formed from the injection chamber 21 to the annular passage 28.

When the operating water ring valve 14 is closed, the operating water is unable to flow out of the outlet valves 8, and the nozzle apertures 12 thus remain open. If, for example, the concentration of the discharge from the nozzles should change, i.e., should become reduced, the nozzle apertures are briefly closed, it being necessary for this purpose to let the operating liquid out of the outlet valves. To this end the ring valve 14 is opened by briefly feeding operating liquid through feed line 19 into passage 32. Thus liquid enters into the annular chamber 36 and exercises on the lip 37 of the ring valve 14 an axial opening pressure which is greater than the closing pressure, which pushes the ring valve downwardly thus opening up the bores 27, 25 and 24, thereby letting the operating liquid escape from the outlet valves 8 and the annular chamber 23 between the upper edge of packing ring 26 and the drum 7. The operating liquid introduced into the annular chamber 36 escapes from the drum through the calibrated bore 33 and overflow bore 35, while the operating liquid in chamber 34 remains, and the ring valve 14 with packing rings 26, as a result of the diminishing opening pressure in the annular chamber 36 but persisting closing pressure in chamber 34, again closes the outlet bores 27, 25 and 24. Thus, the ring valve 14 is movable between the closed position shown in the drawing and an open position, and means are provided for moving the ring valve to the open position wherein the passageway network is opened permitting drawining of operating liquid from the outlet valves and movement of the valve bodies under the centrifugal force to close the nozzle apertures.

The pressure acting on the lip 37 depends on the radial length of the passage 32. Similarly, the force acting on the bottom of the ring valve depends upon the radial depth between the outer extremity of chamber 34 and the overflow bore 35. Since the radial length of passage 32 is much greater than said radial depth, the pressure of the fluid acting on lip 37 is much greater than the pressure acting on the bottom of the ring valve. The pressure can build-up in the annular chamber 36 because the calibrated bores 33 are sized to appropriately limit the flow of fluid from the annular chamber 36 so that the desired pressure build-up is obtained.

As soon as the clear phase discharge of the separator becomes turbid, the opening of the outlet valves again takes place in a known manner.

This construction can also be used in conjunction with additional open nozzles disposed at a shorter distance from the drum axis, which are connected with the periphery of the interior of the drum by bores or passages.

What is claimed is:

1. In a centrifugal separator suitable for the concentration of suspended solids having a rotatable drum, hydraulically operated outlet valves uniformly distributed about the periphery of the drum mantle in the plane of greatest drum diameter and including housings containing nozzles having apertures and movable valve bodies shielded from the pressure of the drum charge, the valve bodies being movable by the centrifugal force of the drum at full rotating speed to close the nozzle aperture, the improvement which comprises a ring valve movable between a closed and an open position, for the hydraulic operation of the outlet valves, a passageway network having an inlet adjacent the drum axis, extending through the ring valve and on to the outlet valves for supplying operating liquid to the outlet valves for holding the valve bodies so that the nozzles are open, said passageway network being closed with the ring valve in the closed position so that the passageway network holds the operating liquid therein, and means for moving the ring valve to the open position wherein the passageway network is opened permitting draining of operating liquid from the outlet valves and movement of the valve bodies under the centrifugal force to close the nozzle apertures.

2. The centrifugal separator of claim 1, said passageway network comprising a common circular chamber for feeding the operating liquid to the individual outlet valves.

3. The centrifugal separator of said claim 2, said passageway network further comprising an operating liquid injection chamber and at least one passage connecting the annular chamber to same.

4. Centrifugal separator of claim 1, wherein the means for moving the ring valve to the open position includes an operating liquid injection chamber and at least one passage thereto for the ring valve and wherein the ring valve operates independently of the outlet valves through said operating liquid injection chamber and passage.

5. The centrifugal separator of claim 1, characterized in that the operating liquid ring valve comprises an axial construction.

6. The centrifugal separator of claim 4, said passageway network comprising a common circular chamber for feeding the operation liquid to the individual outlet valves.

7. The centrifugal separator of claim 1 wherein the ring valve includes operating liquid packing for effecting release of operating liquid.

8. The centrifugal separator of claim 1, characterized in that the ring valve comprises a radial construction.

* * * * *

UNITED STATES PATENT AND TRADEMARK OFFICE

CERTIFICATE OF CORRECTION

PATENT NO. : 4,083,488

DATED : April 11, 1978

INVENTOR(S) : Hubert Gunnewig

It is certified that error appears in the above-identified patent and that said Letters Patent are hereby corrected as shown below:

Column 4, line 24, change "aperture" to --apertures--.

Column 4, line 60, change "operation" to --operating--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*